US006974919B2

(12) United States Patent
Mori et al.

(10) Patent No.: US 6,974,919 B2
(45) Date of Patent: Dec. 13, 2005

(54) SWITCH DEVICE AND HORN SWITCH HAVING THE STRUCTURE OF THE SWITCH DEVICE

(75) Inventors: Naoki Mori, Miyagi-ken (JP); Yasuo Takii, Miyagi-ken (JP); Sun Dong Kim, Gwangju (KR)

(73) Assignee: Alps Electric Co., Ltd., Tokyo (JP)

( * ) Notice: Subject to any disclaimer, the term of this patent is extended or adjusted under 35 U.S.C. 154(b) by 0 days.

(21) Appl. No.: 10/883,145

(22) Filed: Jul. 1, 2004

(65) Prior Publication Data

US 2005/0011736 A1 Jan. 20, 2005

(30) Foreign Application Priority Data

Jul. 14, 2003 (JP) ..... 2003-196294

(51) Int. Cl.[7] ..... H01H 9/00
(52) U.S. Cl. ..... 200/5 R; 200/61.54; 200/517
(58) Field of Search ..... 200/4, 5 R, 5 A, 200/6 R, 17 R, 18, 339, 341, 517

(56) References Cited

U.S. PATENT DOCUMENTS 5,753,874 A * 5/1998 Kossakowski ..... 200/1 B
5,902,972 A * 5/1999 Nestor et al. ..... 200/1 B
6,274,826 B1 * 8/2001 Serizawa et al. ..... 200/5 R
6,355,891 B1 * 3/2002 Ikunami ..... 200/315
6,617,535 B2 * 9/2003 Lacroix ..... 200/339
6,809,278 B2 * 10/2004 Tsubaki ..... 200/341

FOREIGN PATENT DOCUMENTS

| | | |
|---|---|---|
| DE | 93 05 822 | 6/1993 |
| DE | 195 44 769 | 6/1997 |
| EP | 0 678 885 | 10/1995 |
| EP | 1043 748 | 10/2000 |
| EP | 1 168 395 | 6/2001 |
| JP | 2003-123575 | 4/2003 |

* cited by examiner

*Primary Examiner*—Michael A. Friedhofer
(74) *Attorney, Agent, or Firm*—Brinks Hofer Gilson & Lione

(57) ABSTRACT

A switch device whose assembly is easily performed with a simple structure and that has low manufacturing costs includes a case having a rectangular-shaped long groove, a long operating knob held in a vertically movable manner in the long groove, a plurality of operating bodies provided in the longitudinal direction of the long operating knob and operated with the vertical movement of the long operating knob, movable contacts respectively provided below the operating bodies, and a base on which the movable contacts and fixed contacts are mounted such that they can come in contact with or separate from each other. When the long operating knob is pressed, at least one of the plurality of operating bodies is pressed, causing the movable contacts provided below the operating bodies to come in contact with the fixed contacts.

14 Claims, 4 Drawing Sheets

SWITCH DEVICE AND HORN SWITCH HAVING THE STRUCTURE OF THE SWITCH DEVICE

This application claims the benefit of priority to Japanese Patent Application No. 2003-196294 herein incorporated by reference.

BACKGROUND OF THE INVENTION

1. Field of the Invention

The present invention relates to a switch device and, more particularly, to a switch device suitable for a horn switch that is mounted on a pad part of a steering wheel.

2. Description of the Related Art

A conventional switch device typically has a structure in which a knob part is held in a vertically movable manner in a case via a link member which pivots on an operating body, and in which movable contacts are held on a printed board so as to surround fixed contacts formed on the printed board. In this type of structure, the knob part is urged upward by the elastic force of the movable contacts. In this state, when the knob part is pressed; the movable contacts come in contact with the fixed contacts so that the electrical connection therebetween are established (for example, see Japanese Unexamined Patent Application Publication No. 2003-123575).

Hereinafter, the structure of a conventional switch device will be described with reference to the exploded perspective view shown in FIG. 6.

In FIG. 6, the switch device comprises a printed board 31, an elastic sheet 34, a case 36, an operating body 37, a link member 38, and a knob part 39.

A fixed contact 32 is printed on the printed board 31, and an LED 33 is placed adjacent to the fixed contact 32. The elastic sheet 34 is made of a rubber material and is composed of a sheet-like base part 34*a* and an operating part 34*b* protruding from the base part 34*a*. A movable contact 35 is formed below the operating part 34*b*. The case 36 is made of a synthetic resin and consists of a top wall 36*a* with an opening 36*c* and engaging pawls 36*e*, and a sidewall 36*b*.

The operating body 37 is made of the same synthetic resin and consists of an elongated rectangular base part 37*a*, a protruding part 37*c* that projects upward, and a hollow part 37*d* penetrating through both the base part and the protruding part. Further, a circular pressing part 37*e* is provided below the base part 37*a*, and cut recesses 37*f* are provided above the protruding part 37*c*. The link member 38 is a metallic wire rod and is composed of a longitudinal side 38*a*, connecting arms 38*b* bent at both ends of the longitudinal side 38*a*, and protruding parts 38*c*. The knob part 39 is made of a synthetic resin and consists of a top wall 39*a*, elongated sidewalls 39*b*, and projections 39*c* that are provided on the underside of the top wall 39*a*.

The elastic sheet 34 is placed on the printed board 31 having the above structure. The operating body 37 is placed on the elastic sheet 34 so that the operating member 34*b* and the pressing part 37*e* are opposite to each other. The case 36 is attached to the printed board 31 in such a way that the protruding part 37*c* projects upward through the opening 36*c*. The link member 38 engages with the engaging pawls 36*e* so that the protruding parts 38*c* are fitted into the recesses 37*f* of the operating body 37. Then, the protruding parts 38*c* of the link member 38 are pivotally sandwiched between the protrusions 39*c* of the knob part 39 and the recesses 37*f*.

In the switch device having the above structure, when the knob part 39 is pressed, the link member 38 pivots, and the operating body 37 are compressed by the operating part 34*b*, thereby operating the switch. At this time, the longitudinal side 38*a* of the link member 38 is parallel to the longitudinal direction of the operating body 38. Therefore, even if any portion of the knob part 39 is pressed, the operating body 37 is vertically operated, thereby assuring the reliable operation of the switch device.

However, the complex structure of a conventional switch causes assembly to be difficult due to many components. There is also a problem of increased cost of the switch device due to the use of a link member.

SUMMARY OF THE INVENTION

Accordingly, the present invention is designed to solve the above problems, and it is an object of the present invention to provide a switch device whose assembly is easily performed with a simple structure and that has low manufacturing costs.

In order to achieve the above object, a first aspect of the present invention provides a switch device comprising: a case having a rectangular-shaped groove; a long operating knob held in a vertically movable manner in the long groove; a plurality of operating bodies provided in the longitudinal direction of the long operating knob and operated with the vertical movement of the long operating knob; movable contacts respectively provided below the operating bodies; and a base on which the movable contacts and fixed contacts are mounted, the fixed contacts coming in contact with or separate from the movable contacts. In the above switch device, when the long operating knob is pressed, at least one of the plurality of operating bodies is pressed so that the movable contacts provided below the operating bodies come in contact with the fixed contacts.

Further, according to a second aspect of the present invention, the long operating knob is held in a vertically movable manner in the long groove of the case and is also held in order to rock from side to side with a long central part of the long operating knob used as a fulcrum.

Furthermore, according to a third aspect of the present invention, a protruding receiving part is provided below the long operating knob for separating the central-part of the long operating knob from the inner bottom face of the long groove of the case, and the protruding receiving part is used as a rocking fulcrum of the long operating knob.

In addition, according to a fourth aspect of the present invention, the protruding receiving part protrudes from the inner bottom face of the long groove of the case.

Moreover, according to a fifth aspect of the present invention, the movable contacts are composed of dome-shaped rubber contacts, and the fixed contacts are composed of printed contacts formed on a circuit board.

DESCRIPTION OF THE PREFERRED EMBODIMENT

Figure 1:
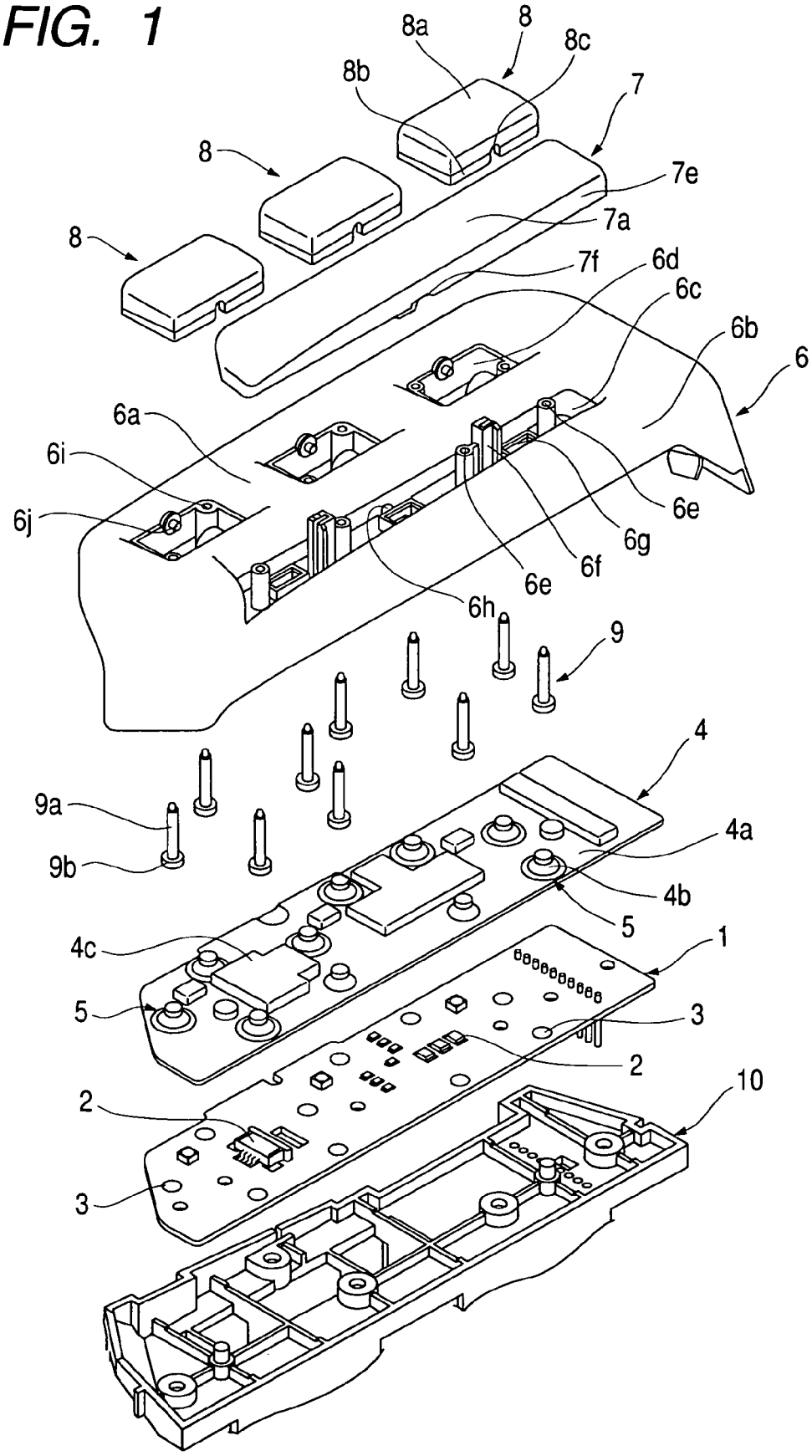
FIG. 1 is an exploded perspective view of a switch device according to one embodiment of the present invention.
Figure 2:
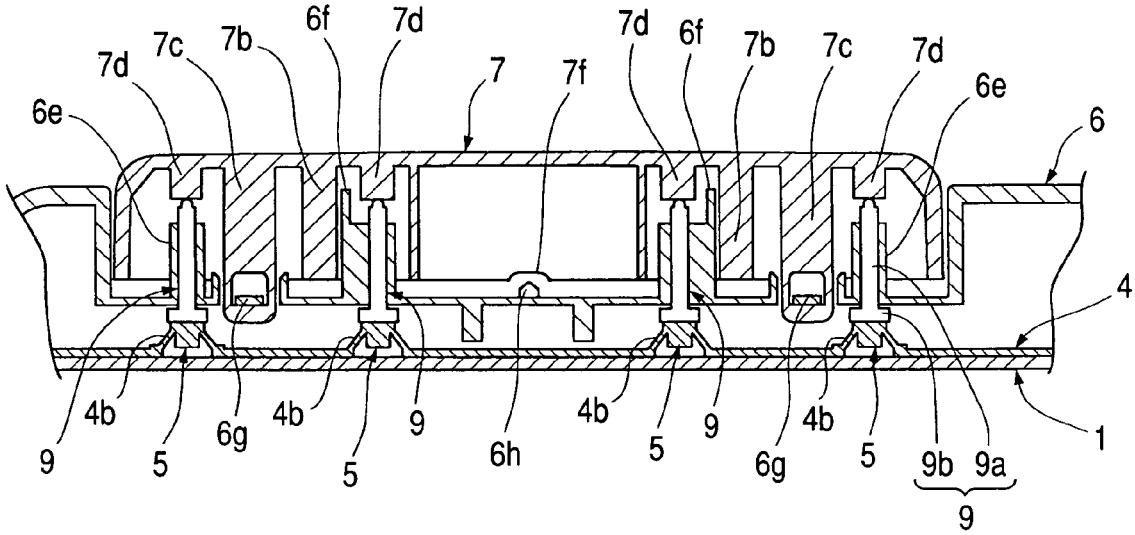
FIG. 2 is a cross-sectional view of principal parts of the switch device according to the present invention.
Figure 3:
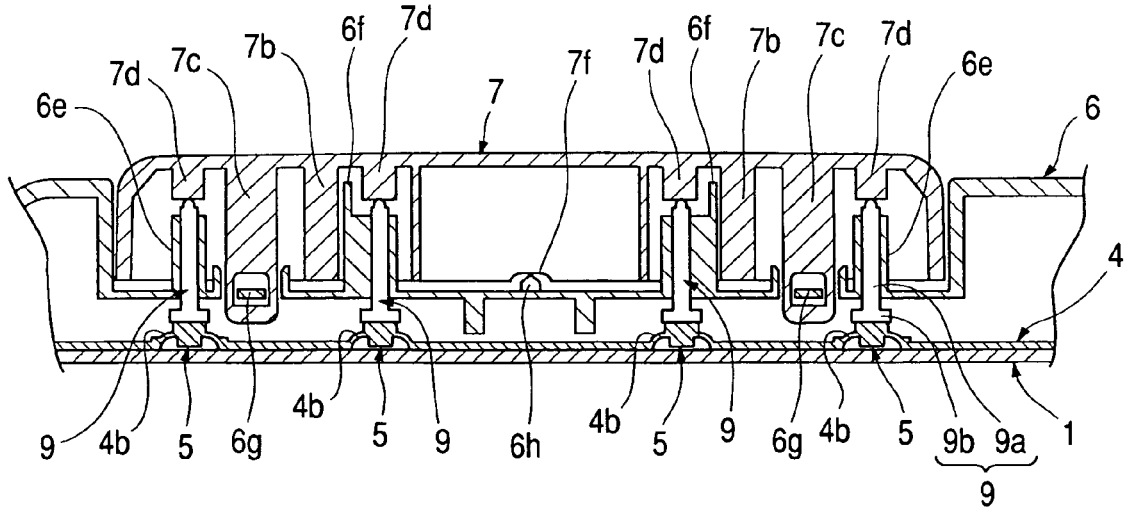
FIG. 3 is a view illustrating the operation of the switch device according to the present invention.
Figure 4:
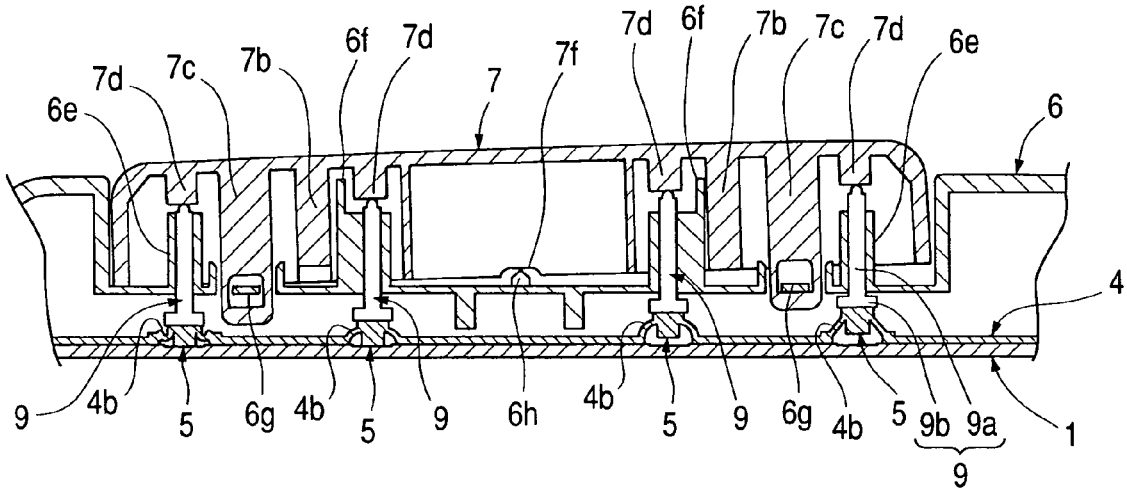
FIG. 4 is a view illustrating the operation of the switch device according to the present invention.
Figure 5:
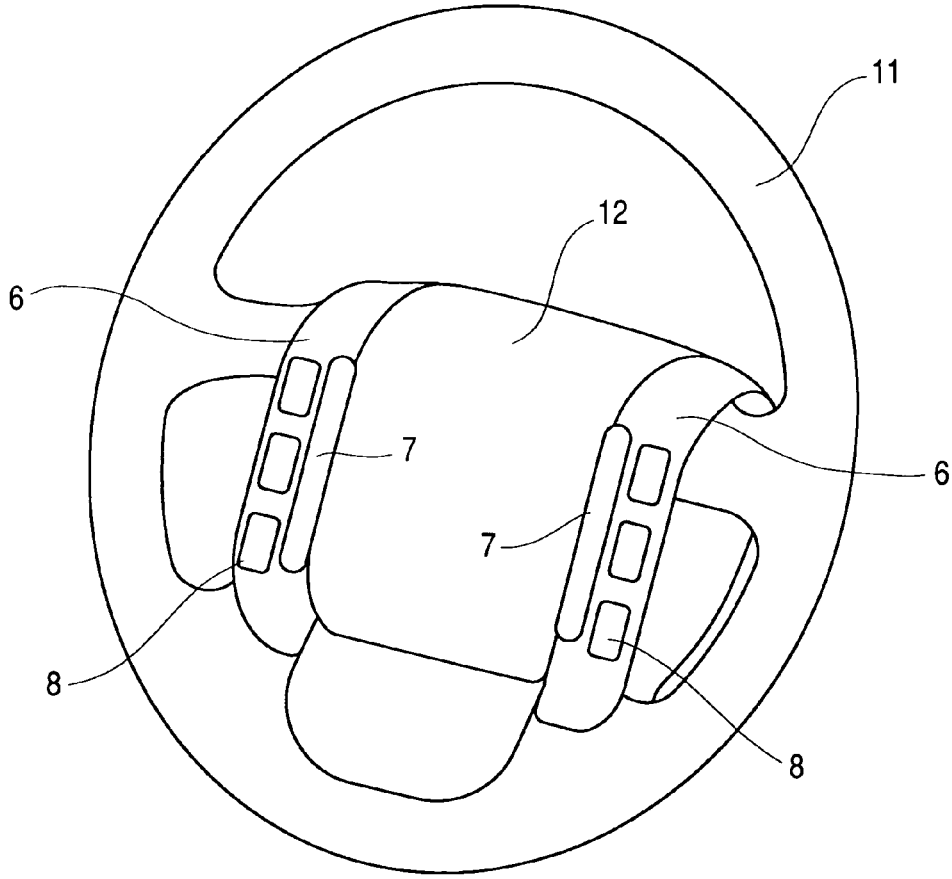
FIG. 5 is a view illustrating an example in which the switch device of the present invention is mounted as a horn switch of a steering wheel.
Figure 6:
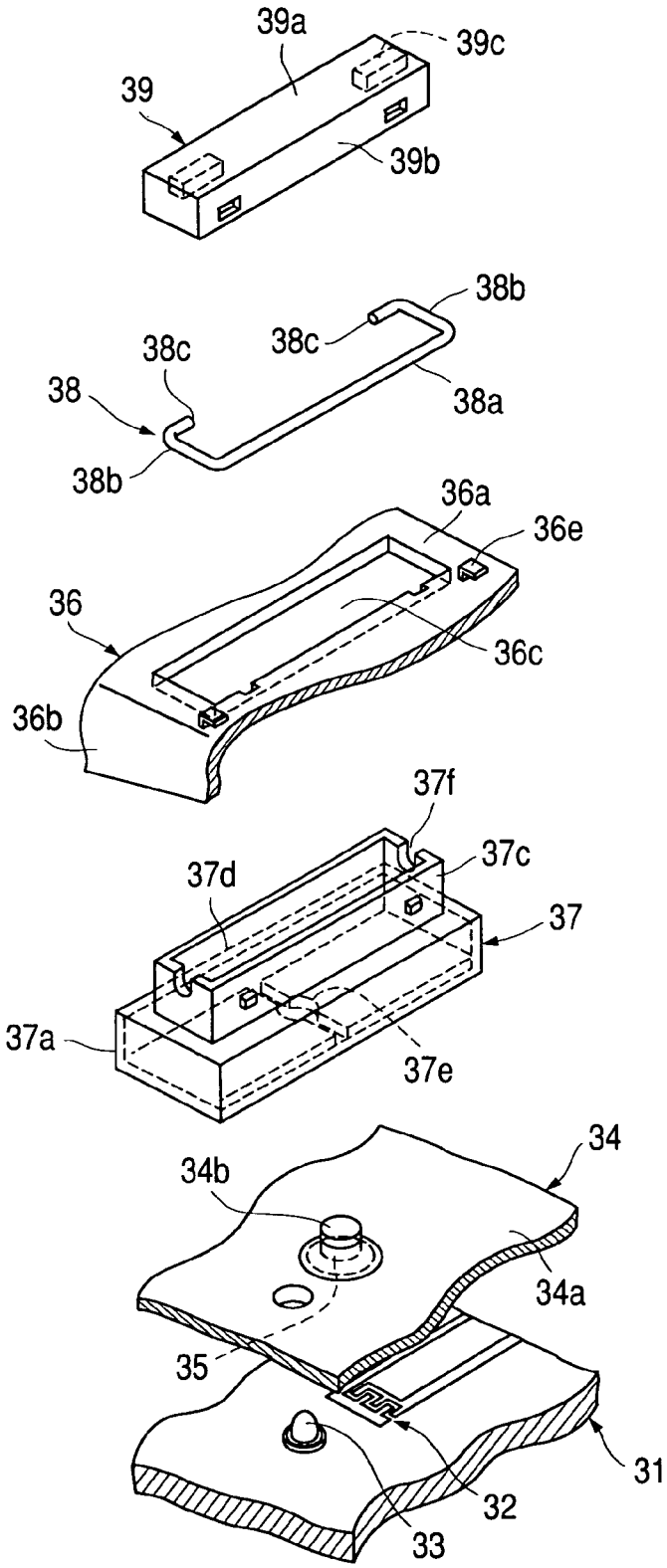
FIG. 6 PRIOR ART
FIG. 6 is an exploded perspective view of a conventional switch device.

Hereinafter, one embodiment of a switch device according to the present invention is shown in FIGS. 1 to 5. FIG. 1 is an exploded perspective view of a switch device according to the present invention. FIG. 2 is a cross-sectional view of principal parts of the switch device. FIGS. 3 and 4 are views illustrating the operation of the switch device. FIG. 5 is a view illustrating an example in which the switch device is mounted as a horn switch on a steering wheel.

In FIG. 1, a circuit board 1 is composed of a substantially rectangular-shaped laminate or similar structure of phenol resin. A plurality of electronic components 2, such as IC modules and chip parts, is mounted on the circuit board 1, which are appropriately connected to circuit patterns (not shown). Further, a plurality of fixed contacts 3 made of a conductive material, such as silver or carbon, is printed on the circuit board 1.

An elastic sheet 4 is made of an elastic material, such as rubber, and is formed in a substantially rectangular shape. The elastic sheet 4 has a sheet-like base part 4*a,* a plurality of dome-shaped operating parts 4*b* protruding upward from and integrally formed with the base part 4*a,* and covers 4*c* used to cover the electronic components 2. On the lower side of the operating parts 4*b,* contact parts (not shown) made of a conductive material, such as carbon, are formed. The operating parts 4*b* and the contact parts together form movable contacts 5.

The elastic sheet 4 is placed on the circuit board 1, and the fixed contacts 3 and the movable contacts 5 are arranged to be opposite to each other. When; the operating parts 4*b* are compressed so that the movable contacts 5 come in contact with the fixed contacts 3 to output signals. The fixed contacts 3 and the movable contacts 5 together form switching parts.

As described above, the movable contacts 5 are composed of dome-shaped rubber contacts, and the fixed contacts 3 are composed of printed contacts formed on the circuit board 1. Therefore, it is possible to simplify the structure of a switch device and thus to achieve the commonality of the switching parts with other switches.

A case 6 formed of an insulating material, such as a synthetic resin, has a top plate 6*a,* a side plate 6*b* formed to extend downward from the top plate 6*a,* and a rectangular-shaped long groove 6*c* and a plurality of rectangular-shaped short grooves 6*d,* both of which are formed in the top plate 6*a*. Further, a plurality of (four in the present embodiment) tubular guide holes 6*e* is provided in the long groove 6*c* along the longitudinal direction of thereof, and operating bodies 9, which will be described later, are inserted through the guide holes 6*e* to move vertically. The long groove 6*c* has a pair of guide posts 6*f* that allow sliding plates 7*b* of a long operating knob 7, which will be described later, to vertically slide. Further, the long groove 6*c* has engaging parts 6*g* that engage with engaging arms 7*c* of the long operating knob 7 to hold the long operating knob 7.

Furthermore, a protruding receiving part 6*h* that projects upward is provided at the center of the inner bottom face of the long groove 6*c*. The operating knob 7 is configured to abut on the protruding receiving part 6*h* so that it can rock around the protruding receiving part. Since the protruding receiving part 6*h* can be integrally formed with the case 6, a rocking fulcrum for the long operating knob 7 can be formed with a simple structure.

In each of the short grooves 6*d,* a pair of guide holes 6*i* through which operating bodies 9, described later, are inserted is provided at two corners of the short groove 6*d* in one diagonal direction. Further, in each of the short grooves 6*d,* supporting shafts 6*j* are provided to rotatably support an operating knob 8, which will be described later.

The operating knob 7 is made of an insulating material, such as a synthetic resin, and is formed in a substantially long rectangular shape. The operating knob 7 has a flat operating plane 7*a* on the upper side thereof, and on the lower side of the long operating knob 7, the sliding plates 7*b* are provided to slide along the guide posts 6*f* provided in the long groove 6*c* of the case 6. Further, the engaging arms 7*c* that engage with the engaging parts 6*g* to be held in the long groove 6*c* are respectively formed to extend downward. Furthermore, the underside of the long operating knob 7 is provided with a plurality of operating protrusions 7*d* that abuts on the upper ends of operating bodies 9, which will be described below, and presses the operating bodies 9 downward. In addition, a recess 7*f* is formed in a central lower end of the long side face 7*e,* and the protruding receiving part 6*h* that is formed at the center of the inner bottom face of the long groove 6*c* abuts on the recess 7*f* so that the long operating knob 7 is provided to be capable of rocking right or left around the protruding receiving part 6*h* that acts as a fulcrum. Further, the long operating knob 7 is mounted in a vertically movable manner in the long groove 6*c* of the case 6.

The operating knobs 8 are made of the same insulating material, such as a synthetic resin. The operating knobs 8 have flat operating planes 8*a* on the upper sides thereof, and on the undersides of the long operating knobs 8, operating protrusions (not shown) that abut on the upper ends of the operating bodies 9 are provided to press the operating bodies 9 downward. Further, a bearing 8*c* is provided at the center of each side face 8*b* to be supported by the supporting shaft 6*j* formed in the short groove 6*d*. Therefore, the long operating knobs 8 are rotatably mounted in the short grooves 6*d* of the case 6.

Each of the operating bodies 9 is made of an insulating material, such as a synthetic resin, and has a rod-shaped shaft part 9*a* and a driving part 9*b* provided at the lower end of the shaft part 9*a*. The shaft parts 9*a* are inserted through the guide holes 6*e* and 6*i* that are provided in the long groove 6*c* and short grooves 6*d* of the case 6 so as to vertically move. The upper ends of the shaft parts 9*a* are arranged to contact the operating protrusions 7*d* of the long operating knob 7 and the operating protrusions (not shown) of the long operating knobs 8. When the shaft parts 9*a* are forced downward by the long operating knobs 7 and 8, the driving parts 9*b* press the operating parts 4*b* of the movable contacts 5 so that the operating parts 4*b* are compressed, causing the movable contacts 5 to come in contact with the fixed contacts 3.

A lower cover 10 is made of an insulating material, such as a synthetic resin, and the circuit board 1 and the elastic sheet 4 are attached thereto. In addition, the lower cover 10 engages with the case 6 to form a housing for the switch device.

Next, the operation of the switch device having the above structure will be described with reference to FIGS. 2 to 4.

First, in an initial state as shown in FIG. 2, the long operating knob 7 is urged upward via the operating bodies 9 by the elastic force of the plurality of dome-shaped operating parts 4*b* on the elastic sheet 4. At this time, the movable contacts 5 are separated from the fixed contacts 3, and all switching parts are turned off.

When a substantially central portion of the long operating knob 7 is pressed while in such a state, as shown in FIG. 3, the whole operating knob 7 moves downward, and the recess 7*f* provided at the central lower end of the long operating knob 7 contacts the protruding receiving part 6*h* provided at the center of the inner bottom face of the long groove 6*c* of the case 6. Although the plurality of operating parts 4*b* is slightly compressed in this state, the movable contacts 5 maintain separated from the fixed contacts 3, and all the switching parts are turned off.

When the force applied to the long operating knob 7 is further increased while in this state, as shown in FIG. 4, the long operating knob 7 rocks (or inclines) in a direction (to the left in this embodiment) to which the stronger pressing force is applied, with the recess 7*f* and the protruding receiving part 6*h* used as a fulcrum. Therefore, the operating bodies 9 on the left of FIG. 2 are pressed downward by means of the operating protrusions 7*d*. Also, the driving parts 9*b* press the operating parts 4*b* of the movable contacts 5 and compress the operating parts 4*b*, and the movable contacts 5 are brought into contact with the fixed contacts 3, resulting in the two left switching parts being turned on.

At this time, since the long operating knob 7 rocks around the recess 7*f* and the protruding receiving part 6*h* that acts as a fulcrum, the functionality of the long operating, knob 7 at the time it is pressed is good, and even when both ends of the long operating knob 7 in its longitudinal direction are pressed, the switching parts can be reliably turned on.

Further, in switching parts other than the pressed switching parts on the left of FIG. 2, i.e., the two switching parts on the right, since the long operating knob 7 can rock (incline) to the right due to the action of the protruding receiving part 6*h* provided in the long groove 6*c*, the right movable contacts 5 and fixed contacts 3 remain separated from each other, resulting in the switching parts being turned off.

In other words, when the long operating knob 7 is pressed, the switching parts to which the stronger pressing force is applied are turned on, and the other switching parts on the opposite side thereof are turned off. Thus, the double click (a phenomenon that, after the switching parts on one side are turned on, the switching parts on the other side are also turned on) can be prevented.

Further, when the pressing force is applied to the right side of the long operating knob 7 in the state shown in FIG. 4, the operation of the protruding receiving part 6*h* causes the ON state of the two left switching parts to be released (turned off), and the two right switching parts are then turned on. Thus, the double click can also be prevented.

In addition, even when the pressing force is strongly applied to the right in the state shown in FIG. 3, the same operation as the one above occurs, and thus a separate explanation thereof will be omitted.

According to the aforementioned configuration, the long operating knob 9 is formed long. Therefore, even when any portion of the long operating plane 7*a* is pressed, the operating plane rocks (inclines) around the recess 7*f* of the long operating knob 7 and the protruding receiving part 6*h* of the long groove 6*c* as a fulcrum, resulting in only the switching parts arranged on one side being turned on. As a result, the switching operation can be reliably performed without the occurrence of the double click.

In addition, the long operating knobs 8 consist of switching parts for a tilting operation, and the operating bodies 9 on the side operated by means of a right or left tilting operation are depressed.

In other words, when a right or left tilting operation is performed, the driving parts 9*b* of the tilted operating bodies 9 press the operating parts 4*b* of the movable contacts 5 arranged below the driving parts 9*b* to be compressed, causing the movable contacts 5 to come into contact with the fixed contacts 3 resulting in those switching parts being turned on.

FIG. 5 illustrates an example in which the switch device having the above structure is mounted on a pad part of a steering wheel of an automobile, wherein reference numeral 11 indicates a steering wheel, and reference numeral 12 indicates a pad part. In this case, the long operating knob 7 formed in the case 6 constitutes an actual horn knob. Further, the long operating knobs 8 are used to switch various functions of vehicle-mounted electronic apparatuses.

According to the aforementioned embodiment of the present invention, the long operating knob 7 is held in the case 6 in a vertically movable manner, and a plurality of operating bodies 9 is provided to operate with the vertical movement of the long operating knob 7 in the longitudinal direction. Therefore, when the long operating knob 7 is pressed, at least one of the plurality of operating knobs 9 is operated so that the movable contact 5 arranged below the corresponding operating body is brought in contact with the fixed contact 3. Thus, unlike the conventional switch device, a link member is not needed to operate the long operating knob 7 or operating bodies 9 vertically when the long operating knob 7 is operated. As a result, since the number of components is reduced, it is possible to facilitate the assembly of the switch device and to reduce the costs of manufacturing the switch device.

In addition, as shown in FIG. 2, a structure in which two switching parts are arranged on the right and left sides of the protruding receiving part 6*h*, respectively, has been described in the embodiment of the present invention. However, one switching part may be arranged on the right and left sides of the protruding receiving part 6*h*, respectively. Also, it goes without saying that one switching part and a simple dome-shaped rubber part for adjusting the operating force may be arranged on the right and left sides of the protruding receiving part 6*h*, respectively. In this case, the structure in which two switching parts are arranged on the right and left sides of the protruding receiving part 6*h*, respectively, as shown in FIG. 2, enables a switching operation without any problem even though a contact failure occurs in any one of the two switching parts respectively provided on the right and left sides of the protruding receiving part 6*h*. As a result, a switch device with high reliability can be provided.

Further, the long operating knob 7 is held in a vertically movable manner in the long groove 6*c* of the case 6 and is held to be capable of rocking right or left around the center of the long operating knob 7 in the longitudinal direction that acts as a fulcrum. Thus, even when the both ends of the long operating knob 7 are simultaneously pressed at the time of depression of the long operating knob 7, only switching parts on the side of the switch device to which the stronger pressing force is applied are turned on. As a result, switching parts on both sides of the switch device can be prevented from being turned on as in the occurrence of a double click.

As discussed above, the switch device of the present invention comprises a case having a rectangular-shaped long groove; a long operating knob held in a vertically movable manner in the long groove; a plurality of operating bodies provided in the longitudinal direction of the long operating knob and operated with the vertical movement of the long operating knob; movable contacts respectively provided below the operating bodies; and a base on which the movable contacts and fixed contacts are mounted such they can come in contact with or separate from each other. When the long operating knob is pressed, at least one of the plurality of operating bodies is pressed, causing the movable contacts provided below the operating bodies to come in contact with the fixed contacts. Thus, when the long operating knob is pressed, a link member is not needed to operate the long operating knob or the operating bodies vertically. As a result, the number of components is reduced, thereby facilitating the assembly of the switch device and reducing the costs of manufacturing the switch device.

In addition, the long operating knob is held in a vertically movable manner in the long groove of the case and is held to be capable of rocking right or left around a long central part of the long operating knob that acts as a fulcrum. Thus, even when the both ends of the long operating knob are simultaneously pressed at the time of depression of the long operating knob, only switching parts on one side of the switch device on which the stronger pressing force is applied are turned on. As a result, it is possible to prevent the switching parts on both sides of the switch device from being simultaneously turned on due to the occurrence of the double click.

Further, a protruding receiving part is provided below the long operating knob for separating the central part of the long operating knob from the inner bottom face of the long groove of the case, and the protruding receiving part is used as a rocking fulcrum of the long operating knob. Thus, the operability at the time of depression of the long operating knob is good, and even if both ends of the long operating knob in its longitudinal direction are pressed, the switch can be reliably turned on.

Furthermore, since the protruding receiving part is formed to protrude from the inner bottom face of the long groove of the case, the protruding receiving part can be integrally formed with the case. Therefore, the fulcrum around which the long operating knob rocks can be formed with a simple structure, and the costs of manufacturing the switch device can be lowered.

Moreover, the movable contacts are composed of dome-shaped rubber contacts, and the fixed contacts are composed of printed contacts formed on a circuit board. Thus, it is possible to achieve the commonality of the switching parts with other switching parts and to simplify the structure of a switch device, thereby lowering the costs of manufacturing the switch device.

What is claimed is:

1. A switch device, comprising:

a case having a rectangular-shaped long groove;

a long operating knob held in a vertically movable manner in the long groove;

a plurality of operating bodies provided in a longitudinal direction of the long operating knob and operated with a vertical movement of the long operating knob;

movable contacts respectively provided below the operating bodies; and a base on which the movable contacts and fixed contacts are mounted, the fixed contacts coming in contact with or separate from the movable contacts, each fixed contact being connected in parallel as a single electrical circuit;

wherein, when the long operating knob is pressed, at least one of the plurality of operating bodies is pressed so that the movable contacts provided below the operating bodies come in contact with the fixed contacts, and the single electrical circuit is completed.

2. The switch device according to claim 1, wherein the long operating knob is held in a vertically movable manner in the long groove of the case and is also held in order to rock from side to side with a long central part of the long operating knob used as a fulcrum.

3. The switch device according to claim 2, wherein a protruding receiving part is provided below the long operating knob for separating a central part of the long operating knob from an inner bottom face of the long groove of the case, and the protruding receiving part is used as a rocking fulcrum of the long operating knob.

4. The switch device according to claim 3, wherein the protruding receiving part protrudes from the inner bottom face of the long groove of the case.

5. The switch device according to claim 1, wherein the movable contacts are composed of dome-shaped rubber contacts, and the fixed contacts are composed of printed contacts formed on a circuit board.

6. A horn switch assembly, comprising a switch device comprising:

a case having a rectangular-shaped long groove;

a long operating knob held in a vertically movable manner in the long groove, the long operating knob being held in a vertically movable manner in the lone groove of the case and also being held in order to rock from side to side with a long central part of the long operating knob used as a fulcrum;

a plurality of operating bodies linearly arranged in a longitudinal direction of the long operating knob and operated with a vertical movement of the long operating knob;

movable contacts respectively provided below the operating bodies, the movable contacts comprising dome-shaped rubber contacts, and the fixed contacts comprising printed contacts formed on a circuit board; and a base on which the movable contacts and fixed contacts are mounted, the fixed contacts coming in contact with or separate from the movable contacts, wherein, when the long operating knob is pressed, at least one of the plurality of operating bodies is pressed so that the movable contacts provided below the operating bodies come in contact with the fixed contacts; and a steering wheel.

7. The horn switch assembly according to claim 6, wherein the long groove includes a plurality of tubular guide holes arranged in the longitudinal direction of the long groove;

each of the operating bodies is inserted through one of the guide holes in a vertically movable manner;

an elastic force of the operating bodies urges the long operating knob upward; and the long operating knob rocks after being moved downward.

8. The horn switch assembly according to claim 7, wherein a recess is provided in a central lower end of a side face of the long operating knob, and a protruding receiving part is provided at the center of an inner bottom face of the long groove.

9. The horn switch assembly according to claim 8, wherein a pair of movable contacts are respectively disposed at opposite sides of the fulcrum.

10. The horn switch assembly according to claim 9, wherein one of the movable contacts and a dome-shaped rubber part are respectively disposed at opposite sides of the fulcrum.

11. The horn switch assembly according to claim 10, wherein two pairs of the movable contacts are respectively disposed at opposite sides of the fulcrum.

12. The horn switch assembly according to claim 6, wherein the long operating knob comprises a plurality of long operating knobs, wherein the case comprises a plurality of cases disposed at opposite sides of the steering wheel, and the long knobs are provided in the cases.

13. The horn switch assembly according to claim 6, wherein a protruding receiving part is provided below the long operating knob for separating a central part of the long operating knob from an inner bottom face of the long groove of the case, and the protruding receiving part is used as a rocking fulcrum of the long operating knob.

14. The horn switch assembly according to claim 13, wherein the protruding receiving part protrudes from the inner bottom face of the long groove of the case.

* * * * *

UNITED STATES PATENT AND TRADEMARK OFFICE

CERTIFICATE OF CORRECTION

PATENT NO. : 6,974,919 B2
APPLICATION NO. : 10/883145
DATED : December 13, 2005
INVENTOR(S) : Naoki Mori et al.

It is certified that error appears in the above-identified patent and that said Letters Patent is hereby corrected as shown below:

On the Title Page

In column 1, item (75), delete "Sun Dong Kim" and substitute --Kim Sun Dong-- in its place.

In the Claims

Column 8, in claim 6, line 30, after "movable manner in the" delete "lone" and substitute --long-- in its place.

Signed and Sealed this

Twenty-first Day of November, 2006

JON W. DUDAS
*Director of the United States Patent and Trademark Office*